US007282680B2

(12) United States Patent
Ryu

(10) Patent No.: US 7,282,680 B2
(45) Date of Patent: Oct. 16, 2007

(54) APPARATUS FOR CONTROLLING INVERTER CIRCUIT OF INDUCTION HEAT COOKER

(75) Inventor: Seung Hee Ryu, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 350 days.

(21) Appl. No.: 10/956,025

(22) Filed: Oct. 4, 2004

(65) Prior Publication Data

US 2005/0247703 A1 Nov. 10, 2005

(30) Foreign Application Priority Data

Apr. 27, 2004 (KR) ..... 10-2004-0028982

(51) Int. Cl.
*H05B 6/04* (2006.01)
*H05B 6/66* (2006.01)

(52) U.S. Cl. ..... 219/661; 219/715

(58) Field of Classification Search ..... 219/661, 219/660, 715; 307/112, 113, 125, 126, 127, 307/128, 130, 131

See application file for complete search history.

(56) References Cited

U.S. PATENT DOCUMENTS 3,593,103 A * 7/1971 Chandler et al. ..... 363/174
4,356,371 A 10/1982 Kiuchi et al.
4,599,504 A 7/1986 Ito
4,757,177 A 7/1988 Suzuki et al.
4,764,652 A 8/1988 Lee
5,343,023 A * 8/1994 Geissler ..... 219/661
5,854,473 A * 12/1998 Malnoe ..... 219/626
6,075,715 A * 6/2000 Maehara et al. ..... 363/37
6,163,019 A * 12/2000 Green et al. ..... 219/660
6,531,689 B2 * 3/2003 Ohishi et al. ..... 219/661
6,870,144 B2 * 3/2005 Ryu et al. ..... 219/626

FOREIGN PATENT DOCUMENTS

KR 10-2004-0102915 A 12/2004

* cited by examiner

*Primary Examiner*—Daniel I. Robinson
(74) *Attorney, Agent, or Firm*—Birch, Stewart, Kolasch & Birch, LLP

(57) ABSTRACT

An apparatus for controlling an inverter circuit of an induction heat cooker which generates and outputs high voltage power to cook food contained in a cooking container is disclosed. The apparatus varies a pulse width of high level interval of a driving pulse according to a level of AC power supplied thereto to vary a switch current of the inverter circuit, and sufficiently secures a turn off time of the driving pulse in proportion to a resonant time varying according to states of separation of the cooking container or the heated food. Therefore, the apparatus improves stability of the switching operation and endurance. Also the apparatus requires relatively low manufacturing costs as the trigger generation is implemented with relatively low-priced amplifiers.

15 Claims, 5 Drawing Sheets

APPARATUS FOR CONTROLLING INVERTER CIRCUIT OF INDUCTION HEAT COOKER

This Nonprovisional application claims priority under 35 U.S.C. § 119(*a*) on Patent Application No(s). 10-2004-0028982 filed in Korea, Republic of on Apr. 27, 2004, the entire contents of which are hereby incorporated by reference.

BACKGROUND OF THE INVENTION

1. Field of the Invention

The present invention relates to an apparatus for controlling an inverter circuit of an induction heat cooker, and more particularly to an apparatus for controlling an inverter circuit of an induction heat cooker capable of generating a driving pulse whose width is varied in response to an input voltage to reduce a voltage difference between both ends of a switch to drive a switching operation of the inverter circuit, and, simultaneously, controlling the inverter circuit so that a turn-off time of the driving pulse is varied according to separation state of the cooking container and a cooking state of food.

2. Description of the Related Art

A cooker such as a rice cooker, an electric pan, a slow cooker, an electric kettle and the like is a device cooking food included in a container thereof by heating the food above a predetermined temperature.

Generally, a cooker includes a body having a PCB (Printed Circuit Board) to operate and determine whether power is applied thereto in response to a user's button operation, a cooking container for containing food to be placed therein, and a heater installed under the cooking container or in the body for heating food.

This specification will be described in respect to an induction heat cooker including coils, each of which is regularly formed in a predetermined part to be put a cooking container, and cooking food in the cooking container made of a magnetic material heated by eddy currents caused by magnetic fields as current flows in the coils.

Referring to FIG. 1, a prior art inverter circuit of an induction heat cooker will be described in detail below.

An inverter circuit 41 of an induction heat cooker switches a switch element to generate a high frequency current with relatively high power and to heat a cooking container including food by induction heat. Such an inverter circuit 41 is switched by a control signal to supply current to coils, thereby supplying heat to the cooking container. The construction of the prior art inverter circuit will be described in detail below.

The inverter circuit 41 includes an AC power source 10 supplying an AC power source to each element, a rectifier 20 for rectifying the AC power source, a filter 30 for filtering the AC power rectified in the rectifier 20 to output a filtered AC power, and a switching unit 40 inputting the filtered AC power and applying a high power to the coils in response to a switching operation.

Also, an inverter circuit controller 81 controlling the inverter circuit 41 includes an input voltage detector 50 for detecting a variation of voltage inputted to the inverter circuit 41 connected to the AC power source 10, a pulse width variation controller 60 varying a width of a driving pulse driving the switching unit 40 in response to a variation of the input voltage, and a gate drive unit 80 for transmitting the driving pulse generated from the pulse width variation controller 60 to the switching unit 40 to perform the switching operation.

Such a pulse width variation controller 60 includes a differential amplifier 61 generating a control signal for varying a width of high level interval of the driving pulse in response to a variation from the input voltage detector 50, and a pulse generation IC (Integrated Chip) 62 for determining a turn-off time of the driving pulse.

Therefore, the width of the driving pulse for driving the switching unit 40 of the inverter circuit 41 is varied such that the width of high level interval of the driving pulse is decreased in a relatively high input voltage portion and the width of high level interval thereof is increased in a relatively low input voltage portion, therefore a voltage increase at both ends of the switch can be repressed when the inverter circuit is driven.

Here, since a turn-off time of the driving pulse is determined by resisters and capacitors each of which has respective values in the inverter circuit, it can be maintained constantly even when heating loads are varied in response to variations of separation state of the cooking container or cooking state of food therein.

FIG. 2 is views illustrating waveforms of a switch voltage and a driving pulse of a prior art inverter circuit in response to variations of heat load. With reference to FIG. 2, the prior art problems will be described in detail below.

A waveform of G1 drawn by a bold line indicates a state that a cooking container is placed to the cooker. Namely, the waveform of G1 is a graph showing that the cooker has normal heat loads as the coils normally contact the cooking container. Also, a waveform of G2 drawn by a dotted line indicates a state that the cooking container is separated from the cooker. Namely, the waveform of G2 is a graph showing that the cooker has no heat load.

The reason why the waveforms G1 an G2 are different is that the cooking container and food, which are referred as heat load, are gradually heated as current flows in the coils, such that the heat load and magnetic characteristics of the coils vary, and thus characteristics of switch voltages differ.

Namely, the heated load of the induction heat cooker is varied according to separation of the cooking container, state variation of heated food, material and deformation of the cooking container, etc. The variation of the heated load causes a resonant inductance value of the coils.

Especially, the resonant inductance value in a state with no heat load, wherein the cooking container is separated, is much greater than that of the inverter circuit, which is previously set. Therefore, a resonant time of the switch element increases.

As such, although the resonant time is varied in response to the variation of the inductance value, the turn-off time of the driving pulse in the prior art inverter circuit is fixedly set when it is manufactured. Therefore, the prior art inverter circuit has disadvantages in that the switch element has a high voltage when it is turned on, if the resonant inductance value is increased.

When the cooking container is separated, or in a no heat load state, if a resonant time is increased by an increased resonant inductance value, the switch element is set to a relatively high switch voltage while it does not secure a relatively sufficient turn off time, and a relatively large short current flows through the switch element. Therefore the switch element is damaged. Accordingly, the damage of the switch element causes a breakdown of the induction heat cooker and burdens a user with costs for repairing the breakdown thereof. Also, they deteriorate the endurance of the cooker.

SUMMARY OF THE INVENTION

Therefore, the present invention has been made in view of the above problems, and it is an object of the present invention to provide an apparatus for controlling an inverter circuit in an induction heat cooker for preventing a relatively high short current from flowing through switching element so as not to damage it, so that a turn off time of a driving pulse driving a switching operation according to a variation of installation/separation state of the cooking container containing food and cooking state of heating food, thereby improving endurance of the induction cooker.

It is another object of the present invention to provide an apparatus for controlling an inverter circuit in an induction heat cooker with a low price, replacing an expensive pulse generating IC (Integrated Chip) with differential amplifiers to vary the width of the driving pulse.

In accordance with the present invention, the above and other objects can be accomplished by the provision of an apparatus for controlling an inverter circuit (410) included in an induction heat cooker which generates and outputs a high voltage power to cook food contained in a cooking container, comprising: an input voltage detector (500) for detecting an input voltage supplied to the inverter circuit (410) from an AC power source; a pulse width variation control signal (PWVCS) generator (600) for generating a control signal which controls a width of a driving pulse for driving a switching operation of the inverter circuit (410) to be varied according to a level of the input voltage detected in the input voltage detector (500); and a trigger generator (700) for varying a turn-on time of the driving pulse according to the control signal and, simultaneously, varying a turn-off time of the driving pulse in proportion to a resonant time changed according to separation of the cooking container from the induction cooker or a state variation of heated food.

Preferably, the input voltage detector (500) comprises a rectifier (510) for rectifying the input voltage to generate a rectified input voltage, and a clamper (520) for clamping the rectified input voltage and outputting a clamped rectified input voltage. Namely, an AC power source is rectified through the rectifier and is then inputted to the clamper.

Preferably, the clamper includes a clamping diode (CD) to clamp a portion of the input voltage, which is below a lower limit reference. Here, the lower limit reference is determined by the number of the clamping diodes connected to each other in series.

Preferably, the PWVCS generator inputs a clamped input voltage and is implemented with, preferably, a differential amplifier. Such a differential amplifier inputs a reference voltage (Vref) of a pulse width variation at its non-inverting terminal and a clamped rectified input voltage (Vb) from a clamping diode of the clamper at its inverting terminal.

Preferably, the PWVCS generator (600) variably controls the width of the driving pulse in such a manner that the pulse width of high level interval is decreased in a positive interval of the clamped rectified input voltage (Vb), and the pulse width of high level interval is increased in an interval except for the positive interval of the clamped rectified input voltage (Vb).

Preferably, the trigger generator (700) detects a voltage difference between both ends of coils, which is varied by separation and deformation of a cooking container, cooking food, or influence of magnetic fields, to adjust a turn off time of the driving pulse.

Preferably, the trigger generator may be implemented with a first differential amplifier and a second differential amplifier. The first differential amplifier (710) outputs a difference between both terminals of the coil heating the cooking container, so that heat load variations according to states of the cooking container and the heated food are detected.

Preferably, the second differential amplifier (720) outputs a driving pulse driving the switching operation of the inverter circuit based on a result of comparing the difference outputted from the first differential amplifier (710) with a preset reference voltage.

Therefore, a switch element can be protected from damage dud to heat load variations as well as a variation of an input power source. Accordingly, the apparatus of the present invention can secure a high reliability of the switching operations and improve endurance.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

With reference to the attached drawings, an apparatus for controlling an inverter circuit of an induction heat cooker according to a preferred embodiment of the present invention will be described in detail below.

It should be noted that the apparatus for controlling an inverter circuit of an induction heat cooker according to the present invention may be modified and changed in numerous and thus the following is simply a description of one preferred embodiment of the present invention. In the following description, a detailed description of known functions and configurations incorporated herein will be omitted when it may make the subject matter of the present invention rather unclear.

Figure 1:
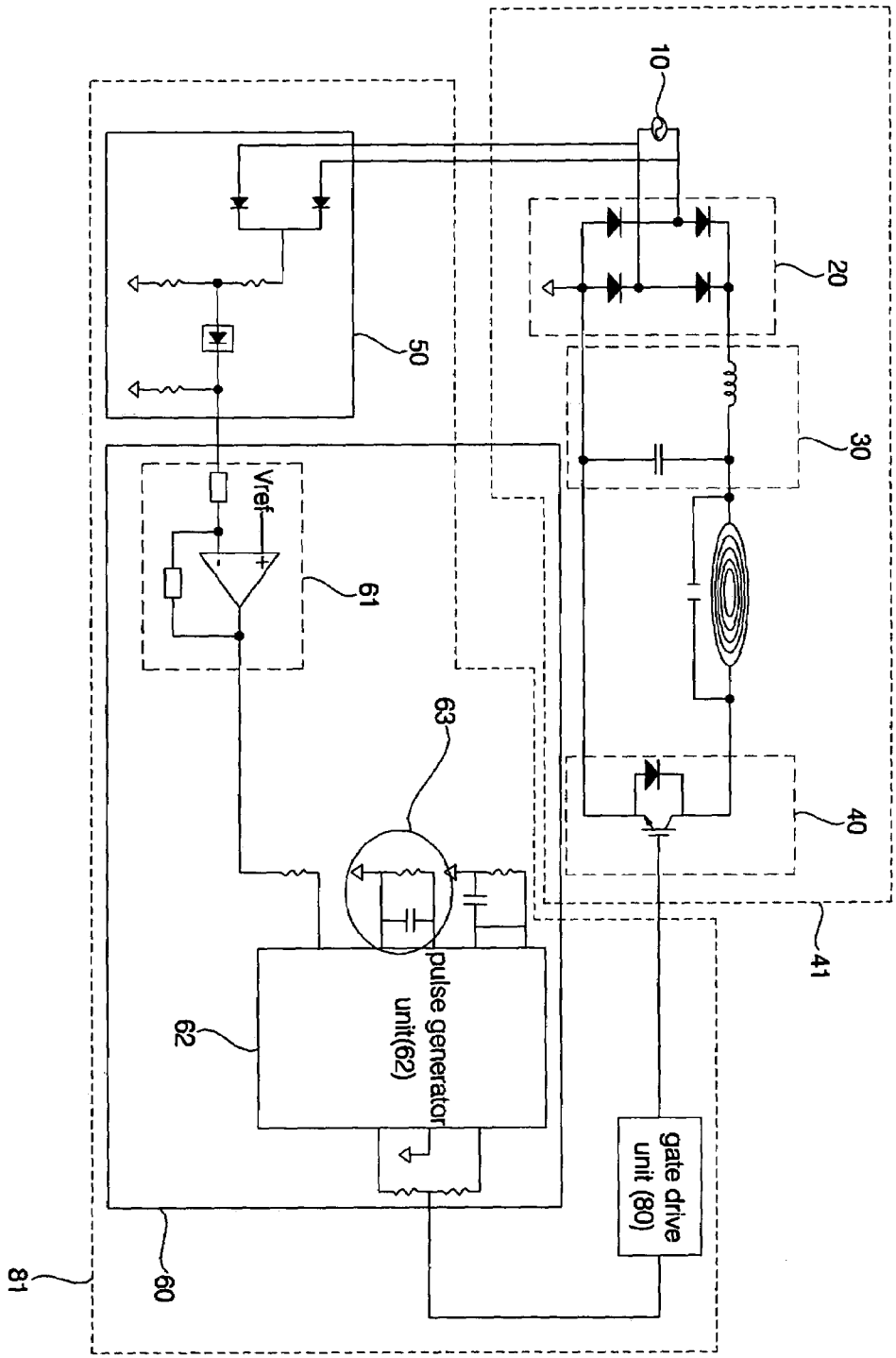
FIG. 1 (Prior Art)
FIG. 1 is a schematic diagram illustrating a prior art apparatus for driving an inverter circuit.
Figure 2:
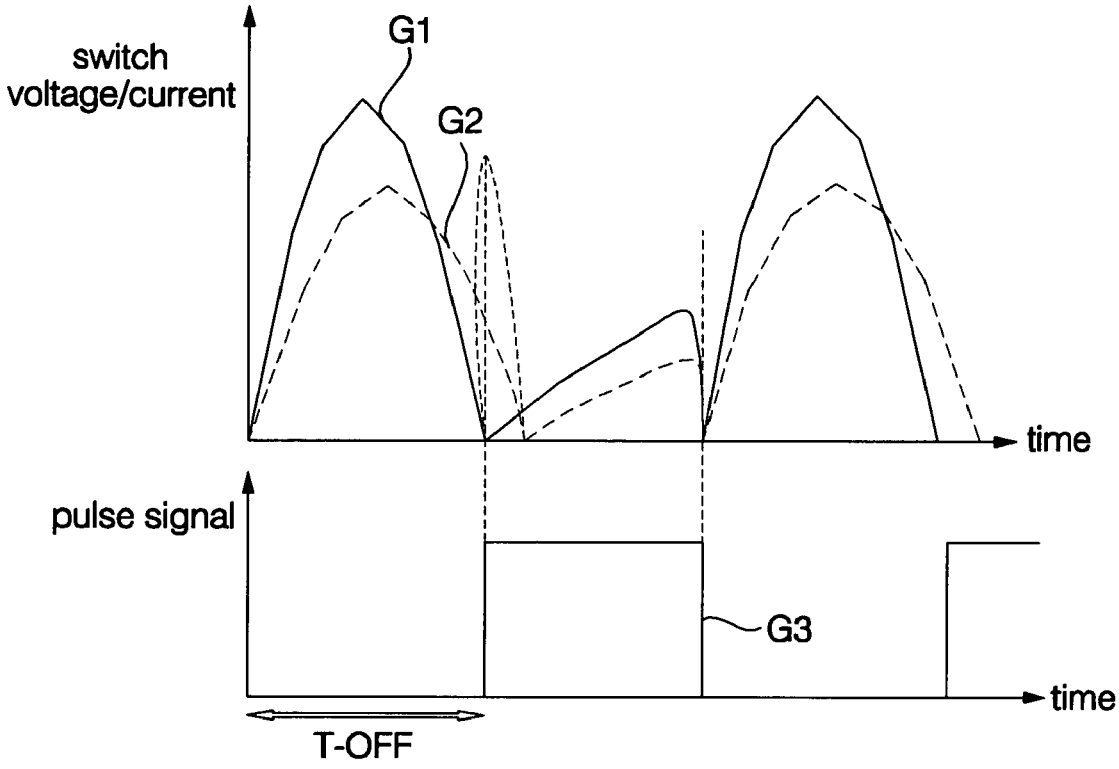
FIG. 2 (Prior Art)
FIG. 2 is waveforms of a switch voltage and a driving pulse of a prior art inverter circuit in response to variations of heat load.
Figure 3:
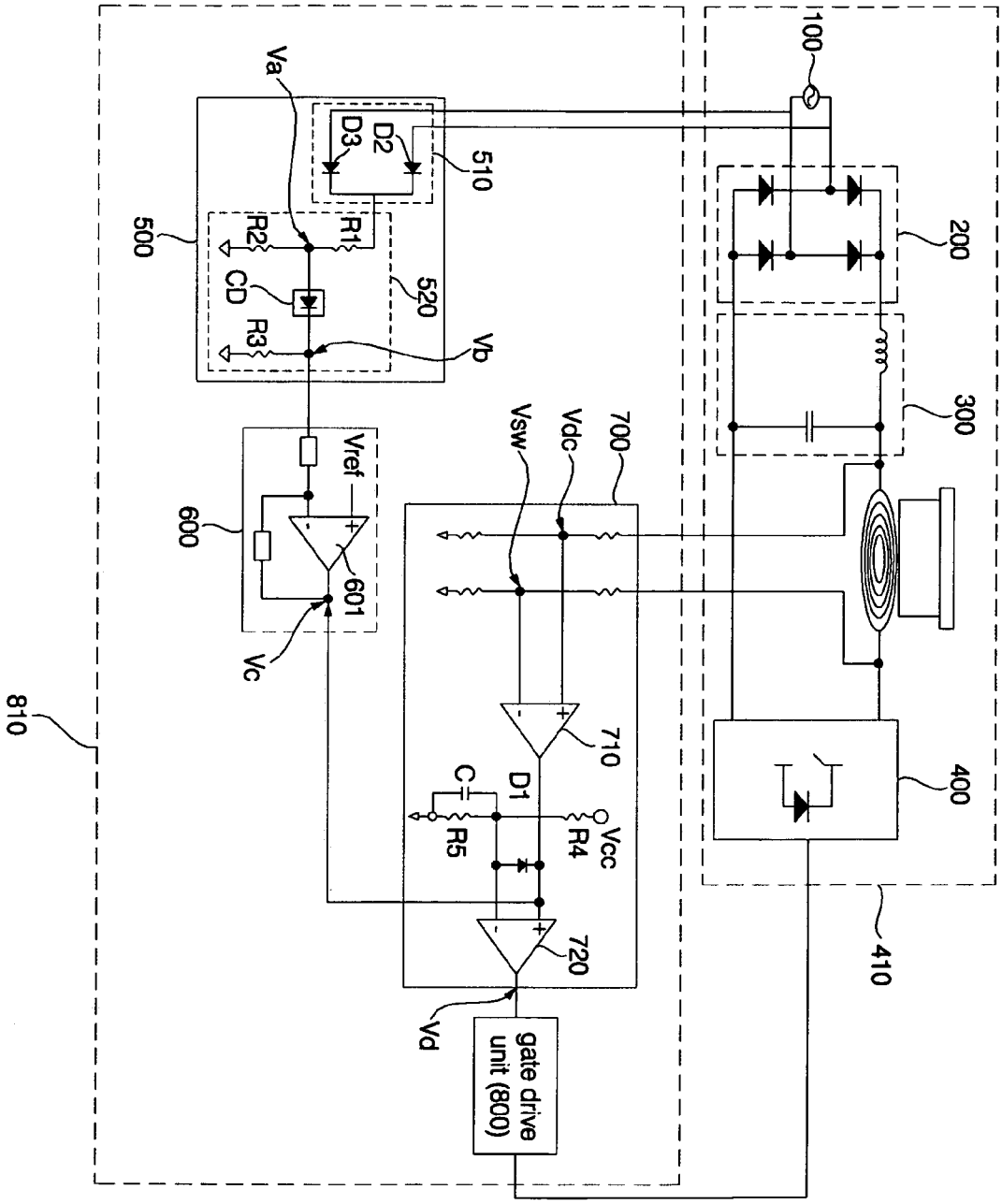
FIG. 3 is a schematic diagram of an apparatus for controlling an inverter circuit according to the present invention.
Figure 4:
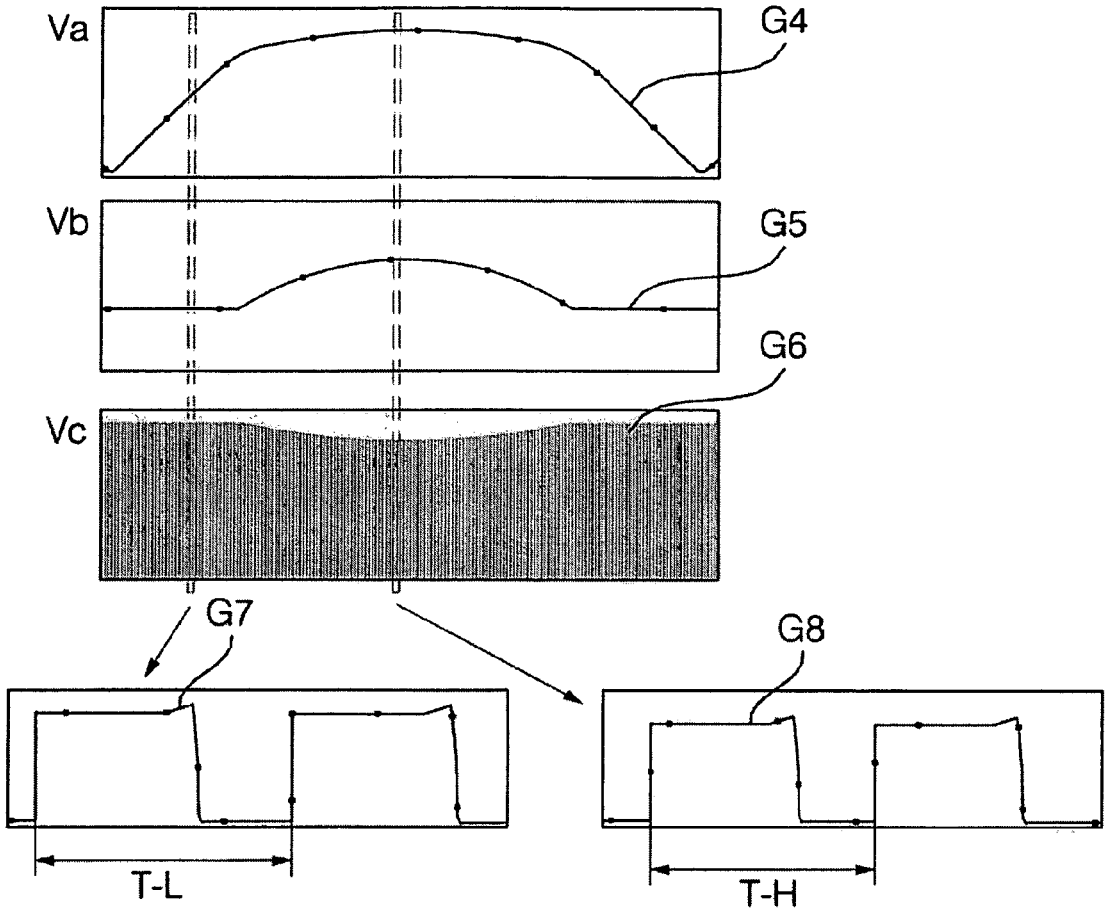
FIG. 4 is waveforms at primary parts of apparatus for controlling an inverter circuit according to the present invention.

FIG. 3 is a schematic diagram of an apparatus for controlling an inverter circuit according to the present invention, and FIG. 4 is waveforms at primary parts of an apparatus for controlling an inverter circuit according to the present invention. With reference to the drawings, the detailed description of the construction of the present invention will be described below.

The inverter circuit 410 is operated by a control command including a heating temperature adjusted by a user, a heating time, and a cooking manner to apply electric power to coils associated with a cooking container, thereby heating the cooking container.

Here, "cooker" is not restricted to a rice cooker, a cooker, an electric pan, a steamer, etc., but rather is used as a general term indicating a device for cooking food in a cooking container heated by induction coils.

Here, the cooking container and food contained therein is referred to as a heating load. When power is applied to coils installed in a body of the heating cooker by a power source, the inverter circuit (410) operates to heat the heat load.

Such an inverter circuit 410 includes an AC power source 100 supplying AC power, a rectifier 200 rectifying the AC power via a rectifying diode, a filter 300 filtering noise of the AC power rectified in the rectifier 200. A switching unit 400 receiving the rectified and filtered powers and performing a switching operation to apply a relatively high power to the coils so that the cooking container is heated.

Here, if variations or noises in the input power applied to the inverter circuit 410 are generated, the switch element of the switching unit 400 is protected from damage as a width of high level interval of the driving pulse for driving the switching unit 400 is adjusted.

Also, a turn-off time of a switch element is varied in response to the variation of the heating load and thusly a width of lower interval of the driving pulse is varied. Therefore, the quantity of current flowing to the switch element is within allowable.

Accordingly, the induction heat cooker according to the present invention can sufficiently secure a turn off time if the cooking container is separated, or in a no heat load state, and thusly a voltage between both ends of the switch element at a time point when the switch element is turned on does not exceed a resistance voltage. Therefore, the switch element is protected from damage.

Namely, if a resonant inductance value of the coils is increased by factors such as deformation of the cooking container, a state change of food, and magnetic fields as well as if the cooking container is separated, a voltage between both ends of the switch element at a turn on time point is decreased as a width of lower interval of the driving pulse is adjusted by the apparatus for controlling an inverter circuit having a trigger generator 700. Therefore, the switching operation can be performed stably.

As such, the apparatus 810 for controlling an inverter circuit controlling the inverter circuit 410 includes an input voltage detector 500, a pulse width variation controlling signal (PWVCS) generator 600, a trigger generator 700 and a gate drive unit 800.

First of all, the input voltage detector 500 includes a rectifier 510 rectifying an input voltage supplied to the inverter circuit 410, and a clamper 520 for claming the input voltage rectified in the rectifier 510.

The rectifier 510 includes rectifying diodes D2 and D3 for rectifying an AC power source of 220V-60 Hz outputted from the AC power source 100 to output a rectified power of 220V-120 Hz. Here, the voltage and frequency may differ depending on countries and local areas.

Here, the rectifier 510 detects a voltage level of the AC power source according as it is directly connected to output terminal of the AC power source 100.

The AC power supplied from the AC power supply 100 is rectified through the rectifier 510 and then inputted to the clamper 520.

The clamper 520 includes a clamping diode CD for claiming a portion of the input voltage, which is below a lower limit reference. Here, the lower limit reference is determined according to the number of clamping diodes connected to each other in series.

Accordingly, the rectified power is divided by a ratio of the resistances of resistors R1 and R2 connected to the anode of the clamping diode CD. The resister R2 has a drop voltage Va, $$220(V) \times \frac{R2}{R1 + R2}.$$

Here, a waveform of the drop voltage Va is shown as G4 in FIG. 4.

A voltage below a reference value is clamped such that the voltage Va of R2 is clamped by the clamping diode CD. Generally, if the threshold is 0.7V per diode, a voltage less than 0.7V may be clamped when the voltage passes through the clamping diode CD. Accordingly, a manufacturer can adjust the clamping voltage to clamp a voltage less than (0.7(V)×No. of diodes)V as the number of diodes CD's is adjusted.

The clamping operation is performed to limit a voltage Vb of R3 to a positive interval for an interval such that a pulse width variation control is performed, before a driving pulse varying a width of high level interval is generated in response to a variation of the AC power for driving a switch element of the inverter circuit 410. A width of the driving pulse is controlled to be varied in proportion to a voltage level only in a positive interval of Vb, the waveform of which is shown as G5 of FIG. 4.

Therefore, if a pulse width is controlled to be varied during the entire interval (time) in which the AC power source is outputted, the clamping diode CD can be removed from the circuit. The higher the level of the input power, the more easily the switch element of the inverter circuit 410 can be damaged. Therefore, an interval of the pulse width variation control can be limited as one or more clamping diodes are connected to each other in series.

The clamped voltage is inputted to a pulse width variation control signal (PWVCS) generator 600. Here, the PWVCS generator 600 is implemented with a differential amplifier 601.

The differential amplifier 601 inputs a reference voltage of pulse width variation at its non-inverting terminal and a voltage Vb passing through the clamping diode CD at its inverting terminal.

A difference between the reference Vref and the voltage Vb is amplified to be inputted to a trigger generator 700 which will be described later, so that the width of high level interval of a driving pulse can be varied in response to the level of an amplified pulse width variation control signal.

Namely, the pulse width variation control signal (PWVCS) generator 600 controls a driving pulse width such that a width of high level interval of the driving pulse is decreased at a positive interval of the clamped voltage Vb and a width of high level interval of the driving pulse is increased at an interval except for the positive one.

In FIG. 4, a waveform G6 indicates a control signal Vc outputted from the PWVCS generator 600, waveforms G7 and G8 are enlarged versions of the waveform G6 to compare a pulse width in a low input voltage with a pulse width variably controlled at a positive interval of the clamped voltage Vb.

If a low input voltage is inputted, a switching operation cannot be properly performed, but, since switch elements cannot be damaged, the pulse width does not need to be controlled. Here, the pulse period is shown as T_L.

Meanwhile, if a high input voltage is inputted to a switching unit 400, a pulse width is variably controlled at a positive interval of the clamped voltage signal Vb for a normal switching operation. As shown in the waveform G8, a pulse width of high level interval is decreased at a point having a maximum input voltage so that a reduced voltage is applied to the switching unit 400. In this situation, the pulse period is shown as T_H, less than T_L.

Therefore, the pulse width driving the switching unit 400 is varied in response to the level of AC power inputted to the inverter circuit 410, such that the turn-on time of the driving pulse is controlled.

Namely, if AC power supplied to the inverter circuit 410 is higher than a reference voltage, the driving pulse is controlled to protect the switch element of the switching unit 400 according as its width at a high level interval is reduced.

The trigger generator 700 operates to causes a circuit operation or a state variation at a rising or falling edge of the input pulse, and generates a driving pulse applied to the switching unit 400 to transmit it to a gate drive unit 800.

The gate drive unit 800 receives the driving pulse from the trigger generator 700 and transmits it to the switching unit 400. Then the switching unit 400 of the inverter circuit 410 is driven.

Accordingly, the switch element is activated when the driving pulse is high and inactivated when the driving pulse is low. Here, the voltage between both terminals of the switch element is referred to as the switch voltage Vsw.

The trigger generator 700 detects a voltage difference between a direct current voltage Vdc applied to the switching unit 400 and the switch voltage Vsw, and maintains a turn off time until the voltage difference is a voltage level triggered by a resistance ratio pre-set in response to a variation of heat load.

Namely, a voltage difference between both ends of coils is varied by separation of a cooking container, deformation of a cooking container, a state change of cooking food or magnetic fields. The trigger generator 700 adjusts a turn off time of a driving pulse based on the voltage difference.

The trigger generator 700 is implemented with first and second differential amplifiers 710 and 720, which are used instead of a relatively expensive IC. First of all, the first differential amplifier 710 outputs a voltage difference between both ends of the coils heating the cooking container to detect a variation of heating load in response to states of the cooking container and heating food.

A DC LINK voltage Vdc inputted to a non-inverting terminal of the first differential amplifier 710 is determined by a resistance ratio of resisters connected to a filter 300 and a first differential amplifier 710.

A switch voltage Vsw generated by a switching operation of the switching unit 400 is inputted to an inverting terminal of the first differential amplifier 710. The switch voltage is determined by a resistance ratio of resisters connected to the switching unit and the first differential amplifier.

Here, a voltage difference between the DC LINK voltage Vdc and the switch voltage Vsw is amplified and then inputted to a non-inverting terminal of the second differential amplifier.

The second differential amplifier 720 generates a driving pulse driving a switching unit based on a result of comparing a voltage outputted from the first differential amplifier 710 with a preset reference voltage.

Here, a turn off time of the driving pulse is determined by a result of comparing a voltage outputted from the first differential amplifier 710 with a preset reference voltage. Also a turn on time is determined by a control signal outputted from the PWVCS generator 600.

Here, the second differential amplifier 720 includes a diode D1 installed at its input terminals. Namely, non-inverting and inverting terminals of the second differential amplifier 720 are connected correspondingly to a cathode and an anode of the diode D1. Therefore, the second differential amplifier 720 is disabled based on a difference between a voltage difference Vcd-Vsw from the first differential amplifier 710 and a pre-set reference voltage.

Here, registers R4 and R5 are connected to the Vcc in series and the voltage of R5 is inputted to the anode of the diode D1. If the voltage difference Vcd-Vsw is positive, a driving pulse is turned on by a pulse width variation control signal. Therefore a turn on time can be sufficiently secured.

Figure 5:
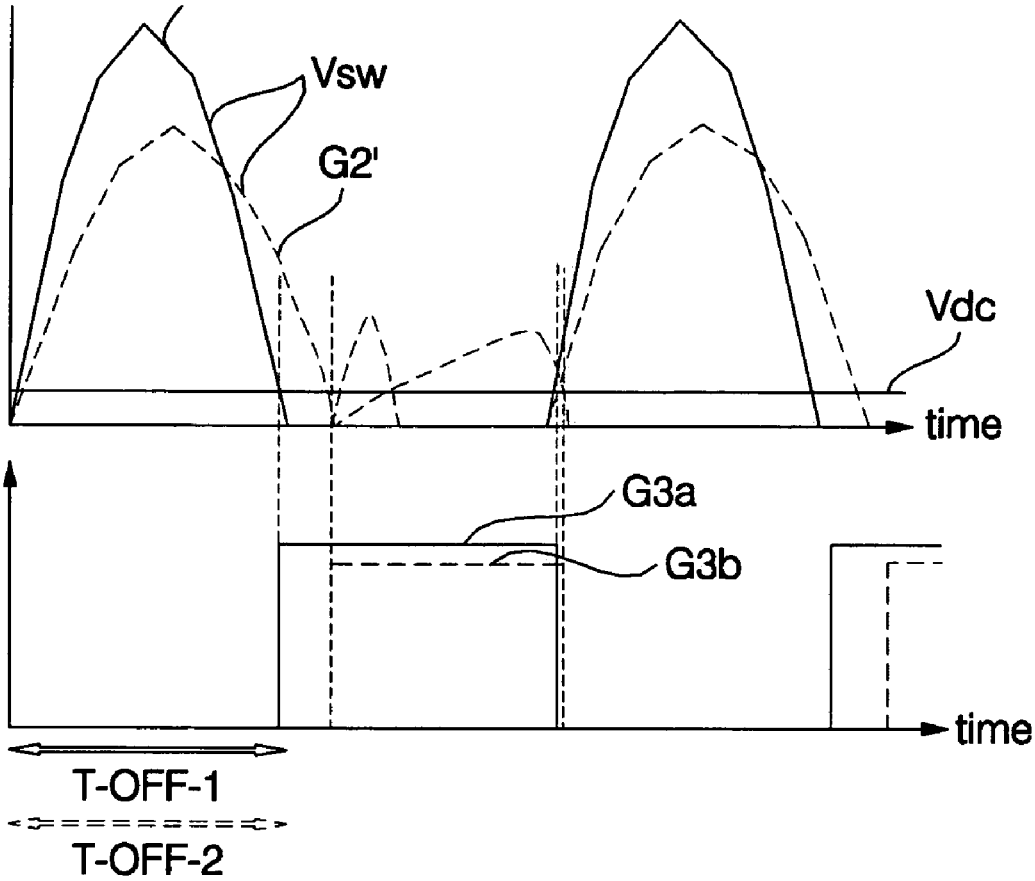
FIG. 5 is waveforms of the switch voltage and driving pulse of an inverter circuit according to the variation of heating load according to the present invention.

Therefore, the present invention resolves the prior art problem that a turn off time cannot be secured in a no-load state because a turn off time of a driving pulse is fixed in the prior art circuit. Namely, the present invention can sufficiently secure a turn on time, even if a switch voltage in a normal heat load, as shown in the waveform G1' of FIG. 5, and a switch voltage in a no-load state, as shown in the waveform G2' of FIG. 5, are different from each other.

Namely, since a driving pulse is set to a high level when a voltage Vsw is sufficiently decreased below Vcd, a turn off time T_OFF_2 in a no-load state can be sufficiently secured, compared with a turn off time T_OFF_1 in a normal state. Therefore, a relatively large current is prevented from being applied to a switch element with a high switch voltage.

As mentioned above, the apparatus for controlling an inverter circuit in an induction heat cooker according to the present invention controls high/low widths of a driving pulse in response to a heat load varying in response to an installed state of a cooking container and a cooking state of food as well as a level of an AC power source supplying power to a switch element, such that a turn off time of the switch element can be sufficiently secured. Therefore, the switch element cannot be damaged and also endurance of the cooker can be sufficiently secured.

Also, the apparatus for controlling an inverter circuit according to the present invention can reduce manufacturing costs, as the conventional expensive pulse generation IC is replaced with relatively low-priced differential amplifiers.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for controlling an inverter circuit of an induction heat cooker generating and outputting a high voltage power to cook food contained in a cooking container, comprising:

an input voltage detector for detecting an input voltage supplied to the inverter circuit from an AC power source;

a pulse width variation control signal generator for generating a control signal which controls a width of a driving pulse for driving a switching operation of the inverter circuit to be varied according to a level of the input voltage detected in the input voltage detector; and a trigger generator for varying a turn-on time of the driving pulse according to the control signal and, simultaneously, varying a turn-off time of the driving pulse in proportion to a resonant time changed according to separation of the cooking container from the induction cooker or a state variation of heated food.

2. The apparatus as set forth in claim 1, wherein said input voltage detector comprises:

a rectifier for rectifying the input voltage to generate a rectified input voltage; and a clamper for clamping the rectified input voltage and outputting a clamped rectified input voltage.

3. The apparatus as set forth in claim 2, wherein said rectifier includes rectifying diodes each of which connected to both terminals of the inverter circuit inputting the input voltage from the AC power source.

4. The apparatus as set forth in claim 2, wherein said clamper includes a clamping diode clamping a portion of the input voltage, which is below a lower limit reference.

5. The apparatus as set forth in claims 4, wherein said low limit reference is determined by the number of the clamping diodes connected to each other in series.

6. The apparatus as set forth in claim 2, wherein said PWVCS generator includes a differential amplifier outputting a PWVCS according as it amplifies a difference between a preset reference voltage and the rectified clamped input voltage.

7. The apparatus as set forth in claim 6, wherein said PWVCS generator variably controls a width of the driving pulse at a positive interval of the clamped rectified input voltage.

8. The apparatus as set forth in claim 7, wherein said PWVCS generator variably controls the width of the driving pulse in the manner that the pulse width is decreased if the clamped rectified input voltage is above a reference voltage, and the pulse width is increased if the clamped rectified input voltage is lower than the reference voltage.

9. The apparatus as set forth in claim 7, wherein said trigger generator includes:

a first differential amplifier for outputting a difference between both terminals of coil heating the cooking container, so that variation states of the cooking container and the heated food are detected; and a second differential amplifier for outputting a driving pulse driving the switching operation of the inverter circuit based on a result of comparing the difference outputted from the first differential amplifier with a preset reference voltage.

10. The apparatus as set forth in claim 9, wherein said second differential amplifier varies the pulse width of the driving pulse according to the control signal outputted from the PWVCS generator.

11. The apparatus as set forth in claim 9, wherein said first differential amplifier outputs a voltage difference between a direct current voltage rectified and filtered in the inverter circuit and a switch voltage generated by the switching operation.

12. The apparatus as set forth in claim 11, wherein said direct current voltage is connected to non-inverting terminal of the first differential amplifier, and said switch voltage is connected to inverting terminal thereof.

13. The apparatus as set forth in claim 10, wherein said second differential amplifier includes a diode, wherein a cathode of the diode is connected to the non-inverting terminal of the second differential amplifier inputting the voltage difference and an anode of diode is connected to the inverting terminal thereof inputting the reference voltage.

14. The apparatus as set forth in claim 13, wherein said diode electrically breaks the non-inverting and inverting terminals of the second differential amplifier based on a difference between the voltage difference from the first differential amplifier and the reference voltage.

15. The apparatus as set forth in claim 14, wherein said second differential amplifier inputs the control signal of the PWVCS generator through the non-inverting terminal.

* * * * *